United States Patent [19]

Akashi et al.

[11] Patent Number: 4,976,014

[45] Date of Patent: Dec. 11, 1990

[54] AUTOMATIC LOCK SLIDER FOR SLIDE FASTENER

[75] Inventors: Shunji Akashi, Kurobe; Kiyoshi Oda, Namerikawa, both of Japan

[73] Assignee: Yoshida Kogyo K. K., Tokyo, Japan

[21] Appl. No.: 424,993

[22] Filed: Oct. 23, 1989

[30] Foreign Application Priority Data

Oct. 26, 1988 [JP] Japan ..... 63-139882[U]

[51] Int. Cl.[5] ..... A44B 19/30

[52] U.S. Cl. ..... 24/421; 24/429

[58] Field of Search ..... 24/421, 418, 419, 420, 24/422, 429, 436

[56] References Cited

U.S. PATENT DOCUMENTS

| | | | |
|---|---|---|---|
| 2,299,133 | 10/1942 | Epes | 24/421 |
| 2,524,574 | 10/1950 | Ryser | 24/421 |
| 2,622,297 | 12/1952 | Erdmann | 24/421 |
| 2,913,795 | 11/1959 | Brown | 24/421 |
| 2,989,792 | 6/1961 | Huelster | 24/421 |
| 3,427,692 | 2/1969 | Rowlands . | |
| 4,662,036 | 5/1987 | Frohlich | 24/421 |

FOREIGN PATENT DOCUMENTS

| | | | |
|---|---|---|---|
| 769355 | 10/1967 | Canada | 24/421 |
| 970537 | 7/1975 | Canada | 24/421 |
| 842632 | 6/1952 | Fed. Rep. of Germany . | |
| 2907232 | 9/1979 | Fed. Rep. of Germany | 24/429 |
| 885858 | 9/1942 | France . | |
| 1194766 | 11/1959 | France . | |
| 2174848 | 10/1973 | France . | |
| 238508 | 11/1945 | Switzerland | 24/421 |
| 264281 | 1/1950 | Switzerland . | |

*Primary Examiner*—Victor N. Sakran

*Attorney, Agent, or Firm*—Hill, Van Santen, Steadman & Simpson

[57] ABSTRACT

An automatic lock slider for slide fastener comprises a slider body, a support lug integral with and disposed over the top surface of the slider body and a pull tab with which to move the slider. The slider includes a locking member in the form of a polygonal leaf spring having at one end a locking prong and at the other end a U-bent portion. A bulged portion is formed intermediate the prong and the U-bent portion and spaced a sufficient distance from the lower surface of the lug to permit lifting of the prong clear out of the passage of coupling element rows of a slide fastener.

8 Claims, 3 Drawing Sheets

AUTOMATIC LOCK SLIDER FOR SLIDE FASTENER'

BACKGROUND OF THE INVENTION

1. Field of the Invention

This invention relates to a slider for slide fastener and has particular reference to a slider having an automatic lock function.

2. Prior Art

There are known numerous automatic lock sliders for slide fasteners.

FIGS. 6 and 7 of the accompanying drawings illustrate a prior art slider encountered with a problem which the present invention seeks to overcome. The prior art slider disclosed in German Patent No. 842632 comprises a slider body 100, a lug or trunnion 110 integrally formed on the top surface of the body 100, a locking spring member 120 interposed between the body 100 and the lug 110 and having a locking prong 130 normally urged downwardly into a guide channel 140 in the body 100 for the passage therethrough of a pair of opposed coupling element rows of a slide fastener (not shown). The locking spring member 120 adapted to lock the slide fastener against longitudinal movement has a profile shown in FIG. 7 and includes a cut-out tongue 150 resting against the bottom wall of the lug 110. The slider body 100 has a mound 160 at its rear end over which the spring member 120 is bent. A pull tab 170 for moving the slider has its pivotal end 180 disposed underneath the spring member 120. When moving this prior art slider in a direction to close the slide fastener; i.e. toward the left as viewed on FIG. 6, this is done by rotating the pull tab 170 counter-clockwise into a position beyond a vertical axis of the slider body 100. However, due to the structural features of the slider illustrated in FIG. 6, the spring member 120 is prone to move back down at its rear end against upward pull exerted by the pull tab 170 so that the locking prong 130 fails to retract away from the passage of the fastener element rows and tends to scratch the surfaces of the latter during closing operation of the slider.

SUMMARY OF THE INVENTION

It is therefore the primary object of the present invention to eliminate the above problem of the prior art slider.

According to the invention, there is provided an automatic lock slider for slide fastener which comprises a slider body including a pair of parallel spaced upper and lower wings joined at their front end by a neck so as to define therebetween a guide channel for the passage of a pair of opposed rows of coupling elements, a support lug integral with and disposed over the top surface of said upper wing, a pull tab pivotally supported in said lug, and a locking member in the form of a polygonal leaf spring having at one end an integral locking prong normally urged into said guide channel and at the other end a U-bent spring portion and a bulged portion intermediate said prong and said U-bent portion, said bulged portion being spaced apart from the lower surface of said lug by a sufficient distance to permit lifting of said locking prong clear out of said guide channel, and said U-bent portion being spaced slightly apart from the lower surface of said lug and from the top surface of said upper wing, respectively.

The invention will be described in detail by way of example with reference to the accompanying drawings.

Like reference numerals refer to like or corresponding parts throughout the several views.

DETAILED DESCRIPTION

Figure 1:
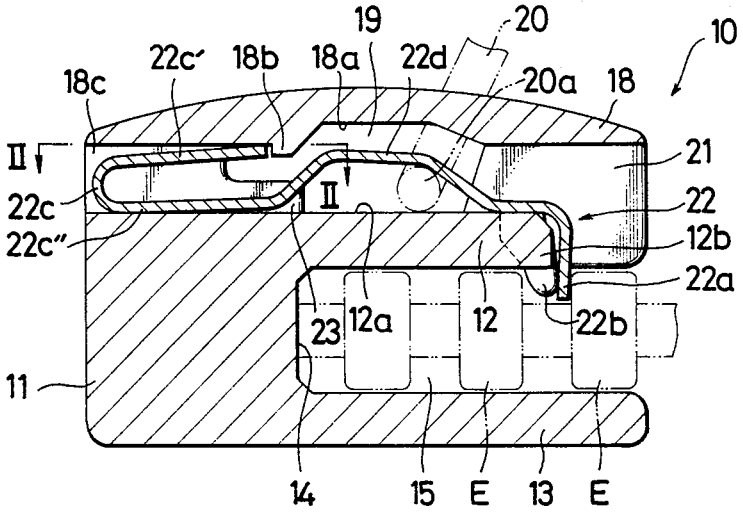
FIG. 1 is a longitudinal cross-sectional view of a slider for slide fastener emboding the present invention.
Figure 3:
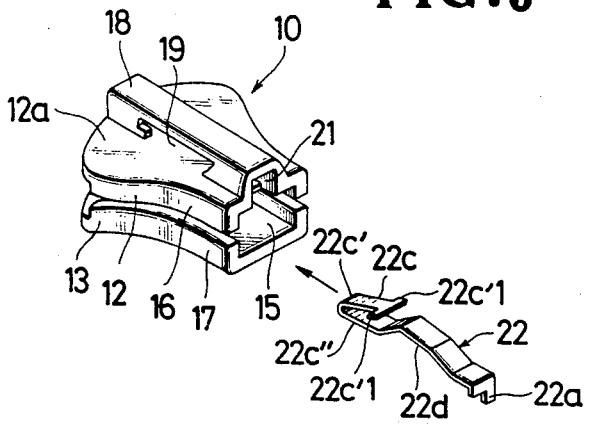
FIG. 3 is a perspective view of the slider of FIG. 1 with a part isolated.

Referring now to the drawings and FIGS. 1 and 3 in particular, there is shown an automatic lock slider 10 for slide fastener provided in accordance with the invention. The slider 10 comprises a slider body 11 including a pair of parallel spaced upper and lower wings 12, 13 joined at their front end by a neck 14 (otherwise known as a "diamond") so as to define therebetween a substantially Y-shaped guide channel 15 for the passage of a pair of opposed coupling element rows E of a slide fastener (not shown). The upper wing 12 has a pair of flanges 16, 16 directed inwardly respectively from opposite lateral edges thereof and spaced from a corresponding pair of similar flanges 17, 17 of the lower wing 13 as better shown in FIG. 3.

A support lug or trunnion 18 integral with and disposed on a flat top surface **12*a* of the upper wing 12 is provided centrally with an elongated aperture 19 for receiving a pull tab 20 pivotally therein in a well known manner. The lug 18 also has a longitudinal slot 21 communicating with the aperture 19 and adapted to receive therethrough a locking member 22 in the form of a polygonal leaf spring of the configuration illustrated in FIG. 3**.

The top surface **12*a* of the upper wing 12 has a central portion registering with the slot 21 and offset at its rear end relative to the lower wing 13 to provide an abutment 12*b* against which one end of the locking member 22** bears as later more fully described.

Figure 2:
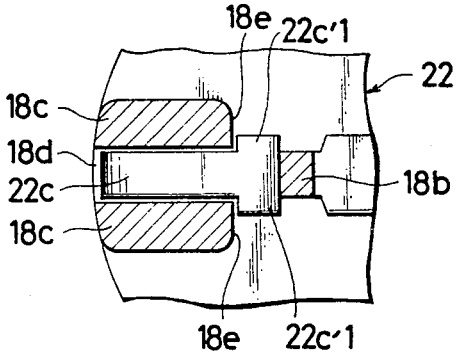
FIG. 2 is a cross-sectional view taken on the lines II—II of FIG. 1.

The locking member 22 has at one of its end a first locking prong **22*a* and a second locking prong 22*b* laterally formed adjacent the first prong 22*a*, both prongs 22*a* and 22*b* being integral with the member 22 and normally urged downwardly into the guide channel 15. The locking member 22 has at the other end a U-bent spring portion 22*c* including an upper leg 22*c*' and a lower leg 22*c*'', the upper leg 22*c*' having lateral protuberances 22*c*'1, 22*c*'1 at its terminal end as shown in FIGS. 2 and 3. The locking member 22 includes a bulged portion 22*d* intermediate between the prong 22*a* and the U-bent portion 22*c* and defining with the top surface 12*a* of the upper wing 12 a cavity 23 for receiving a hook end 20*a* of the pull tab 20 as better shown in FIGS. 1 and 4**.

The lug 18 has a concaved lower surface portion **18*a* configured in conformity with the contour of the bulged portion 22*d* of locking member 22 and spaced apart therefrom a sufficient distance to permit lifting of the locking prong 22***a* clear off the guide channel 15. The lug 18 includes a downward projection 18*b* serving as an abutment against which the terminal end of the upper leg 22*c*′ of the U-bent portion 22*c* bears.

As better shown in FIG. 2, the front end portion of the lug 18 which registers in position with the neck 14 of the slider body 11 is internally bifurcated to provide opposed side walls 18*c*, 18*c* between which is formed a cavity 18*d* for accommodating the U-bent portion 22*c* of the locking member 22. The bifurcated side walls 18*c*, 18*c* have respective vertical abutments 18*e*, 18*e* against which the protuberances 22*c*′1, 22*c*′1 of the locking member 22 rest, so that the locking member 22 are arrested against longitudinal back and forth displacement during manipulation of the pull tab 20.

The locking member 22 is assembled in place within the slider body 11 with the first locking prong 22*a* borne against the abutment 12*b* of the upper wing 12, with the terminal end of the upper leg 22*c*′ of the U-bent portion 22*c* borne against the projection 18*b* and with the protuberances 22*c*′1, 22*c*′1 of the upper leg 22*c*′ borne against the abutments 18*e*, 18*e* of the side walls 18*c*, 18*c*, the locking member 22 being thus wholly disposed in a snugfit with the lug 18. In this disposition, the upper leg 22*c*′ of the U-bent portion 22*c* is slightly spaced apart from the lower surface of the lug 18 adjacent the front end of the slider body 11 and the lower leg 22*c*″ is likewise spaced from the top surface of the upper wing 12, so that the U-bent portion 22*c* can reserve sufficient spring action.

Figure 4:
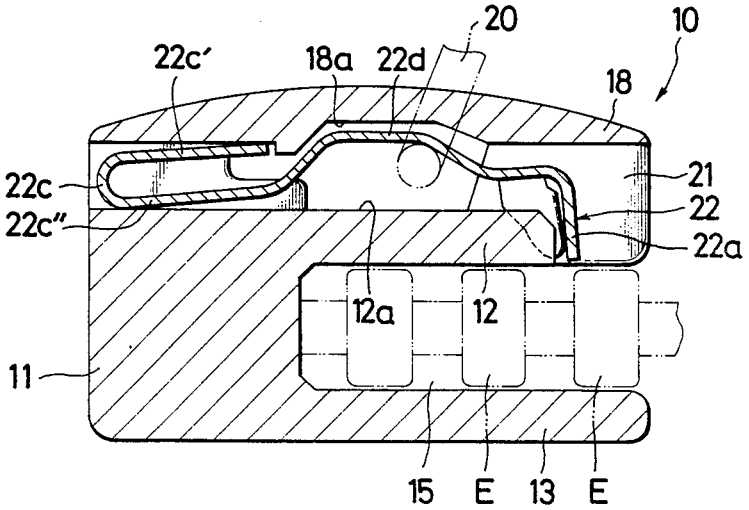
FIG. 4 is a view similar to FIG. 1 but showing the slider in a position to couple opposed rows of fastener elements or close a slide fastener.

When moving the slider 10 leftward as viewed in the drawings or in a direction to close the slide fastener, the pull tab 20 is rotated counter-clockwise from the position of FIG. 1 to the position of FIG. 4 and pulled to lift the locking member 22, hence the locking prong 22*a* out of the guide channel 15 thereby releasing the coupling elements E of the slide fastener. Since there is sufficient clearance between the bulged portion 22*d* of the locking member 22 and the lower surface 18*a* of the lug 18, the locking prong 22*a* can be lifted clear out of the passage of the coupling elements E of the fastener, eliminating the risk of scratches or damage to the elements E.

Figure 5:
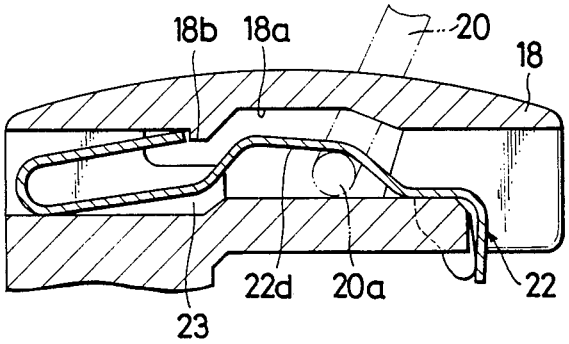
FIG. 5 is a longitudinal cross-sectional view of a portion of a modified form of slider embodying the invention.
Figure 6:
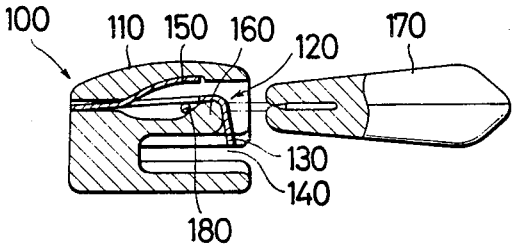
FIG. 6 PRIOR ART
FIGS. 6 and 7 illustrate the prior art slider already described herein above.
Figure 7:
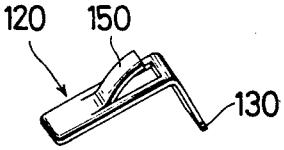
FIG. 7 PRIOR ART

FIG. 5 shows a modified form of slider which is similar to the slider 10 above described and shown in FIG. 1 except that the top surface 12*a* of the upper wing 12 at the front end thereof is cut away to widen the gap 23 between the lug 18 and the upper wing 12 but to reduce the overall thickness of the slider 10.

Obviously, various modifications and variations of the present invention are possible in the light of the above teaching. It is therefore to be understood that within the scope of the appended claims the invention may be practiced otherwise than as specifically described.

What is claimed is:

1. An automatic lock slider for slide fastener which comprises a slider body including a pair of parallel spaced upper and lower wings joined at their front end by a neck so as to define therebetween a guide channel for the passage of a pair of opposed rows of coupling elements, a support lug integral with and disposed over the top surface of said upper wing, a pull tab pivotally supported in said lug, and a locking member in the form of a polygonal leaf spring having at one end an integral locking pron normally urged into said guide channel and at the other end a U-bent spring portion and a bulged portion intermediate said prong and said U-bent portion, said bulged portion being spaced apart from the lower surface of said lug by a sufficient distance to permit lifting of said locking prong clear out of said guide channel, and said U-bent portion being spaced slightly apart from the lower surface of said lug and from the top surface of said upper wing, respectively.

2. An automatic lock slider according to claim 1 wherein said lug has a downward projection for abutting engagement with the terminal end of said U-bent portion.

3. An automatic lock slider according to claim 1 wherein said locking member has lateral protuberances for abutting engagement with abutments of said lug.

4. An automatic lock slider according to claim 1 wherein the top surface of said upper wing is flat.

5. An automatic lock slider according to claim 1 wherein the top surface of said upper wing at the front end thereof is cut away to reduce the overall thickness of the slider.

6. An automatic lock slider according to claim 1 further including a second locking prong laterally formed integral with said locking member and disposed adjacent said first locking prong.

7. In an automatic lock slider slide fastener of the type including a slider body having a pair of parallel spaced upper and lower wings joined at their front end by a neck so as to define a guide channel for the passage of a pair of opposed rows of coupling elements, a support lug integral with and disposed over a top surface of said upper wing, and a pull tab pivotably supported in said lug, a locking member in the form of a polygonal leaf spring comprising the following:

a first end including a U-bent portion;

a second end including a pair of locking prongs normally urged into said guide channel; and a bulged portion disposed between said first and second portions and spaced apart from a lower surface of said lug to permit lifting of said locking prongs from said guide channel.

8. A locking member according to claim 7, wherein said locking prongs are disposed laterally of, and adjacent to, one another.

* * * * *